United States Patent [19]

Eriksen

[11] Patent Number: 4,504,359

[45] Date of Patent: Mar. 12, 1985

[54] ASSEMBLY FOR TREATMENT OF AN ENDLESS WIRE OR FELT

[75] Inventor: Gunnar Eriksen, Asker, Norway

[73] Assignee: Thune-Eureka A/S, Tranby, Norway

[21] Appl. No.: 409,433

[22] Filed: Aug. 19, 1982

[30] Foreign Application Priority Data

Jul. 21, 1982 [NO] Norway ..... 822518

[51] Int. Cl.[3] ..... D21F 1/32

[52] U.S. Cl. ..... 162/274; 26/106; 100/93 RP; 162/199; 162/275

[58] Field of Search ..... 162/274, 275, 358, 359, 162/199; 28/240; 140/108; 100/93 RP; 26/51, 99, 106

[56] References Cited

U.S. PATENT DOCUMENTS 3,617,444 11/1971 Hundseid ..... 162/274 X
4,232,435 11/1980 Eriksen ..... 26/106
4,233,011 11/1980 Bolender et al. ..... 100/93 RP X

FOREIGN PATENT DOCUMENTS 140685 7/1979 Norway .

*Primary Examiner*—William F. Smith
*Assistant Examiner*—K. M. Hastings
*Attorney, Agent, or Firm*—Pasquale A. Razzano

[57] ABSTRACT

An assembly for treatment of an endless wire or felt which passes around a support roll comprises a transversely elongated support frame, rails, means at each end of the frame for movable support of the frame on the rails into and out of a surrounding position in relation to the support roll, and a roll which is transversely disposed within the frame, as well as means for holding the roll in the frame in such a position within the frame that at a first surrounding position of the frame in relation to the support roll the frame roll obtains contact with the felt on the support roll and at a second surrounding position of the frame in relation to the support roll the frame roll obtains contact with a free section of the felt adjacent the support roll. The roll on the frame can be heated and has a drive motor for rotary movement of the roll about its longitudinal axis.

4 Claims, 3 Drawing Figures

ASSEMBLY FOR TREATMENT OF AN ENDLESS WIRE OR FELT

Figure 1:
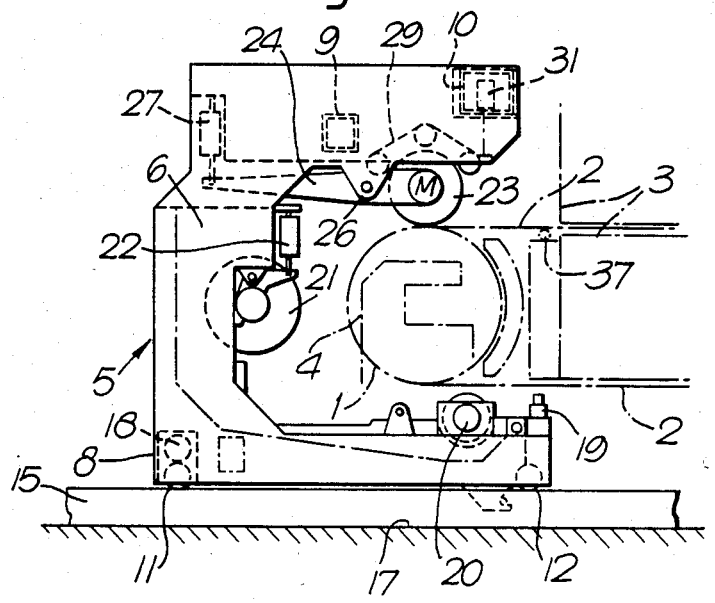

Stretching, drying and fixing assemblies are utilized in the paper-making industry for treating felts and wires of synthetic material. For example, felts/wires of synthetic material must be fixed before they are installed in a paper-making machine, and this is done in an apparatus of the above type, by a combination of heat and stretch treatment. The felt/wire is usually also subjected to other treatment processes before it is considered to be finish-treated.

Such stretching, drying and fixing assemblies for felts and wires for paper-making machines comprise at least two rolls which can be moved in parallel in relation to each other.

Such an assembly, hereafter termed a stretching machine for the sake of simplicity, may with advantage comprise a so-called "service unit" in the form of an independent carriage which can be moved toward and away from one of the said rolls. This carriage, suitably formed as a frame structure on wheels, carries the process equipment which is used for treatment of the wire/felt. Thus, equipment for precompacting, heat-smoothing, washing, chemical treatment and singeing the surface of the threated web may be carried on the frame. Such a service unit is shown and described in U.S. Pat. No. 3,617,444.

For pre-compacting the felt, a press roll is utilized. The surface of the felt is smoothed and the process reduces the break-in period for a new felt in a paper-making machine. Heretofore, a cold press roll has normally been utilized, which is brought to bear with a dead weight load against the felt passing around the support roll on the stretching machine, and this has produced acceptable results. A trend in the direction of higher loading at the press nip, however, has rendered such dead weight load insufficient, and greater press nip loads will have a significant influence on the shape of the nip between the rolls, which makes it impossible to obtain an approximately parallel nip with variable felt widths and loads. Therefore, it has been suggested to form the press roll so that it can be crowned. Such a roll is shown and described, e.g., in U.S. Pat. No. 2,908,964. In U.S. Ser. No. 356,393 filed Mar. 9, 1982, a press roll is described which can be acted upon by external pressure members distributed over the length of the roll.

One of the support rolls in a stretching machine, usually the drive roll, is very often made so that it can be heated. Such a roll may for instance be heated by circulating hot oil, which enables one to control and maintain the temperature of the roller surface at a constant level up to around 300° C. Surface contact with a heated roller has a favourable flattening effect on the felt and will give the felt a smooth and uniform surface. This hot roller can also be utilized for drying, curing and similar purposes in connection with the treatment of felts and wires. If cooling is needed, this can also be done, with the oil then being utilized for cooling rather than for heating. Several such heatable rollers are known. One embodiment has been shown and described in Norwegian Pat. No. 140,685.

A drawback of the known equipment in which a support roll for the felt is heated so as to act upon the felt is that only one surface of the felt is affected by the treatment. It is desirable, however, to process both surfaces of the felt, and in order to do this, the felt, following treatment of the first side, must be turned inside out on the support roll and driven through the assembly with the previous outer side of the endless web then facing inwardly. This is naturally a time-consuming procedure, and such reversing of the felt is also undesirable in itself. A solution to this problem is to provide a heatable roll for heat-treating the outer surface of the felt loop, while the inner surface of the felt is simultaneously being heat-treated by the support roll arranged inside the felt loop.

According to the invention, it is proposed to provide an external, heatable roll in a service unit of the type discussed above, and in particular, it is suggested that the already existing press roll in the service unit also be utilized as a heated roll.

In accordance with the invention, therefore, an assembly for treatment of an endless wire or felt which passes around a support roll is proposed, comprising an elongated, transversely extending support frame, rails, means at each end of the frame for movable support of the frame on the rails into and out of a surrounding position in relation to the support roll, a roll disposed transversely within the frame, means for holding the frame roll in such a position within the frame that at a first surrounding position of the frame in relation to the support roll said frame roll obtains contact with the felt/wire on the support roll and at a second surrounding position of the frame in relation to the support roll said frame roll obtains contact with a free section of the felt/wire adjacent to the support roll, a means for exerting pressure by the frame roll against the felt/wire, a means for heating the frame roll, and a means for rotary movement of the frame roll.

That which characterizes the assembly of the invention, therefore, is such that a heatable, driveable roll is placed and arranged in such manner in a movable service unit or carriage that it can be utilized as a press roll against a roll in the stretching machine, and that it can be moved, by moving the service unit, for use as a surface treatment roll having surface contact against the felt/wire in a free web section thereof.

The invention may with advantage be utilized in connection with a service unit of the type shown and described in U.S. Pat. No. 3,617,444, thus obtaining a very useful, universal unit. The felt can be treated on both sides simultaneously, and reversing of the felt is no longer required. This is an important advantage, because it is not only time-consuming but a difficult and cumbersome precedure to reverse a felt in this way, considering that such felts are quite wide (10 meters or more) and that the felt is a relatively long and endless web.

The combined press and heating roll may suitably be of the type described in Norwegian Pat. No. 140,685, and in connection with the roll, load-transmitting equipment as shown and described in U.S. Ser. No. 356,393 filed Mar. 9, 1982.

Figure 2:
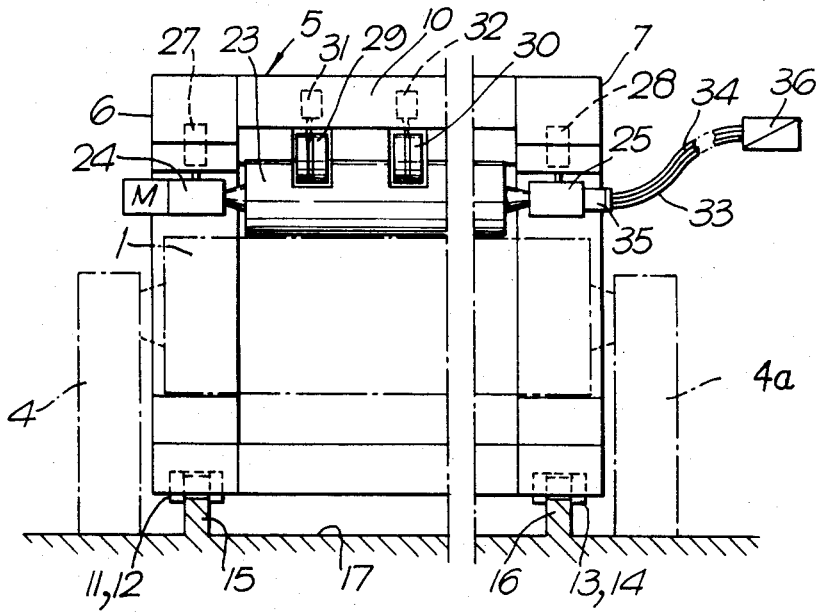
Figure 3:
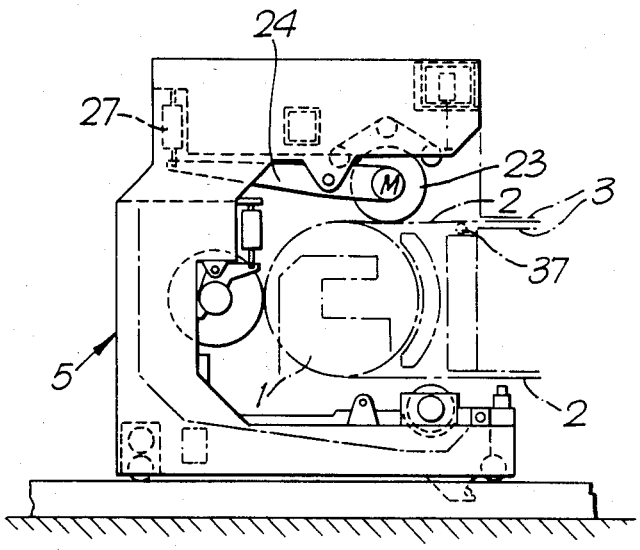

The invention will be described in greater detail in the following with reference to the accompanying drawings, wherein:

FIG. 1 shows an end view of a service unit containing a roll in accordance with the present invention, FIG. 2 shows the service unit of FIG. 1 head-on, as seen from the right in FIG. 1, and FIG. 3 shows the service unit of FIG. 1 in a displaced position in relation to the support roll for the felt, as compared to the position shown in FIG. 1.

The figures are schematic in nature and show only those components considered necessary for understanding the idea of the invention. In FIG. 2, some of the equipment in the service unit has purposely been omitted, for better viewing.

In the drawings, the broken lines indicate a support roll 1 for a felt 2. The felt 2 travels as shown around the support roll 1, the upper section of the felt passing into a drying section 3. The roll 1 is supported at both ends in bearing foundations 4 and 5. The above-mentioned components constitute parts of the stretching machine itself. At the other end of the endless felt 2 (not seen in the drawings), the felt passes around a second support roll which is rotatably mounted in a stretching carriage. The felt 2 is moved in the stretching machine by means of the support roll 1, which acts as the drive roll in the assembly. The drive means for the drive roll is not illustrated, as this forms part of the prior art.

The service unit, drawn with solid lines, is made as a carriage 5, constructed with two end sections 6 and 7, in this case formed as box structures, and the sections 6 and 7 are rigidly connected to each other by means of cross beams 8, 9 and 10. Wheels 11, 12 and 13, 14 are mounted on the respective sections 6 and 7, travelling along respective rails 15, 16 in the floor 17. The wheels 11, 13 are driven by means of a suitable motor 18. The carriage 5 can thus be moved along the rails 15, 16 toward and away from the support roll 1.

Various equipment for treating the felt 2 is mounted in the carriage or service unit 5. Component 19 is a singeing burner for singeing the surface of the felt, 20 is a roller for applying chemicals to the felt for chemical treatment thereof, and 21 is a washing roller for washing the felt. These components are known per se and do not directly form part of the invention, and will not be discussed in further detail here. It should be noted, however, that the singeing burner 19, the chemical roller 20 and the washing roller 21 can be moved into contact with the felt 2 by means of suitable, known means. When the washing roll 21 is to be brought into contact with the felt as it passes around the roll 1, the carriage 5 is naturally driven a distance toward the right in FIG. 1, whereupon the washing roll can be pressed against the felt with the aid of a working cylinder 22.

Pivotally mounted at the upper part of the service unit is a roll 23, which in the position illustrated in FIG. 1 acts as a press roll against the felt 2 on the support roll 1. In FIG. 3, the service unit 5 has been moved farther in a direction toward the support roll 1, so that the roll 23 can be utilized as a hot roll, in surface contact against the felt 2.

The roll 23 is supported in the carriage 5 by means of two arms 24, 25. Each arm 24, 25 is pivotally mounted on the carriage 5 as shown at 26, and the free end of each arm is connected to a working cylinder, 27 and 28 respectively, whereby the respective arms can pivot about the support point 26 in the carriage 5, for moving the roll 23 toward and away from the felt 2. A motor M is mounted on the arm 24 and connected to the roll 23, for rotary movement of the roll 23. In addition, several belt/roller assemblies 29, 30 are mounted and pivotally supported in the carriage 5 in a manner not illustrated in the drawings, which can be pressed against the roll 23 by means of associated working cylinders 31, 32. For further details in this connection, refer to U.S. Ser. No. 356,393 filed Mar. 9, 1982.

The roll 23 can be heated and may be constructed, e.g., as shown and described in Norwegian Pat. No. 140,685. A supply hose 33 and a return line 34 for the oil which is utilized for heating the roll are shown in FIG. 2. The conduits 33, 34 are connected to the journal extension 35 on the roll 23, externally of the support arm 25, and are also, in a manner known per se, connected to a heat exchanger 36. The connection to the heat exchanger is formed so as to enable oil supply and oil return to the heat exchanger over the area of movement for the entire carriage. Such arrangements are well known and will therefore not be described further here.

When the carriage 5 is in the position illustrated in FIG. 1 in relation to the support roll 1 and the felt 2 carried therein, the roll 23 is used as a press roll. The pressure of the roll can be varied over its length by means of the belt assemblies 29, 30. Alternately, one could naturally omit such belt assemblies or similar members and let the roll rest with a dead weight load against the felt 2 and the underlying support roll 1.

In the position of the carriage 5 shown in FIG. 3, the carriage has been driven farther toward the right, closer to the support roll 1 and the felt 2 supported thereon. It may be seen that the roll 23 now is displaced and rests against a free section of the felt, adjacent the support roll 1. The roll 23 now has surface contact with the felt 2 and preferably rests on the free felt section, the load being regulated by means of the working cylinders 27. The roll 23 rotates by means of the motor M, and it is heated by hot oil from the heat exchanger 36 (FIG. 2). If the support roll 1 also is made as a heated roll, the two surfaces of the felt can be heat-treated simultaneously.

In FIGS. 1 and 3, a smaller support/guide roll 37 is shown, which in this case forms part of the drying box 3. This roll 37 acts as support for the felt 2 when load is applied to it by the roll 23 in FIG. 3, but its primary function is to serve as a guide roll for guiding the felt 2 into the air gap in the drying box 3. It will be understood that a supporting roll 37 of this type is not necessary in connection with the use of the roll 23 as a hot roll. The upper section of the felt thus can travel unsupported from the roll 1 in a direction toward the other support roll (not illustrated).

Having described my invention, I claim:

1. An assembly for treatment of an endless wire or felt comprising, in combination, a support roll around which said felt passes, and an independent carriage separate from said support roll and adapted to be moved toward and away from the support roll, said carriage having a first roll mounted therein with its longitudinal axis extending generally parallel to the longitudinal axis of said support roll, said first roll being positioned in said carriage for pressing against the support roll and the felt/wire supported on the support roll when the carriage is in a first position with respect to the support roll; means for heating the first roll and means for driving the first roll in rotation about its longitudinal axis in the carriage; said carriage being dimensioned to permit movement of the carriage to a second position wherein said first roll is positioned inwardly of the support roll above the felt/wire in surface contact with a free unsupported section of the felt.

2. An assembly for treatment of an endless wire or felt comprising, in combination, a support roll, a transversely elongated support frame, rails, means on said frame for movably supporting the frame on the rails for movement into and out of a surrounding position in relation to the support roll, a first roll rotatably mounted within the frame with its longitudinal axis extending generally parallel to the longitudinal axis of said support roll, said first roll being located in such a position within the frame that at a first position of the frame in relation to the support roll said first roll is in contact with a portion of the felt/wire as it passes over the support roll, said frame being dimensioned to permit movement of the frame to a second surrounding position of the frame in relation to the support roll, where said first roll is in contact with a free unsupported section of the felt/wire adjacent the support roll but spaced therefrom, means for pressing said first roll against the felt/wire at each of said two positions, means for heating said first roll, and means for rotating said first roll about its longitudinal axis.

3. An assembly as defined in claim 2 wherein said frame is generally C-shaped in side view and said first roll is mounted in the upper portion of the frame.

4. An assembly as defined in claim 3 including a second roll, parallel to said first roll, mounted in said frame approximately 90° away from the first roll, said second roll being positioned in the frame to contact the felt/wire on the support roll in the second position of the frame but not in the first position.

* * * * *